United States Patent [19]

Fair

[11] 4,108,592

[45] Aug. 22, 1978

[54] IGNITER FOR GAS FIRED TORCHES

[76] Inventor: Carl Fair, 316 SE. Pine, Roseburg, Oreg. 97470

[21] Appl. No.: 736,749

[22] Filed: Oct. 28, 1976

[51] Int. Cl.[2] ..... F23Q 3/00

[52] U.S. Cl. ..... 431/128; 431/263

[58] Field of Search ..... 431/127, 128, 264, 263

[56] References Cited

U.S. PATENT DOCUMENTS

| | | | |
|---|---|---|---|
| 1,915,446 | 6/1933 | Pressler | 431/128 |
| 3,801,260 | 4/1974 | Irwin | 431/128 |

FOREIGN PATENT DOCUMENTS

| | | | |
|---|---|---|---|
| 29,613 of | 1912 | United Kingdom | 431/128 |

*Primary Examiner*—Edward G. Favors

*Attorney, Agent, or Firm*—James D. Givnan, Jr.

[57] ABSTRACT

A device having a two piece housing on the cover of which are mounted the electrical components of an arc producing circuit including a sparkplug projecting upwardly through the cover. A partially closed hood about the sparkplug confines torch emitted gases for ignition by the sparkplug. A switch control arm is located for torch tip actuation during a lighting operation.

1 Claim, 3 Drawing Figures

IGNITER FOR GAS FIRED TORCHES

BACKGROUND OF THE INVENTION

The present invention relates generally to a device providing momentary arcing for ignition of a wide variety of gas burning torches including both self-contained, as well as tank supplied.

Commonly torches are lit by hand operated flint igniters with the torch in one hand and the igniter in the other. In a number of job operations such full use of the worker's hands for torch ignition is of little concern. In many instances, however, it is highly desirable that torch ignition be accomplished with one hand while the other hand holds or steadies the workpiece. Such is the case with a great number of acetylene torch users such as jewelers and hobbyists.

The use of hand operated igniters in the field incurs the drawbacks of same being easily misplaced or malfunctioning.

SUMMARY OF THE PRESENT INVENTION

The present invention is embodied in a compact device intended for table top placement or tank attachment and having a switch control for contact with the torch tip for closure of an igniting circuit.

The present device is enclosed within a housing and is compact design enabling convenient use of same on crowded work benches or convenient tank attachment. A sparkplug projects through the housing wall and is secured thereon in conjunction with a semi-closed hood which serves to confine torch emitted gas for torch ignition. Accordingly, ignition occurs in a positive manner with little risk of dangerous gas collection as could occur from repeated misfirings. A switch arm is so disposed so as to be contacted by the torch tip as same is brought into position with the above mentioned hood. The ignition circuit includes, in addition to the above sparkplug, a coil, a power source, switch and capacitor.

Important objectives of the present igniter include the provision of an igniter for various type of gas fired torches the igniter device including a housing on which hood-like fitting or enclosure is located for the collection of torch emitted gases for ignition purposes; the provision of an igniter device having a novel housing and sparkplug combination to provide a highly compact igniter structure for convenient use in a wide variety of locations; the provision of an igniter having a circuit closing switch with a switch actuating arm disposed for closure by a torch tip as it is brought into register with the hooded sparkplug.

Additional objectives will become subsequently apparent.

DETAILED DESCRIPTION OF THE PREFERRED EMBODIMENT

Figure 1:
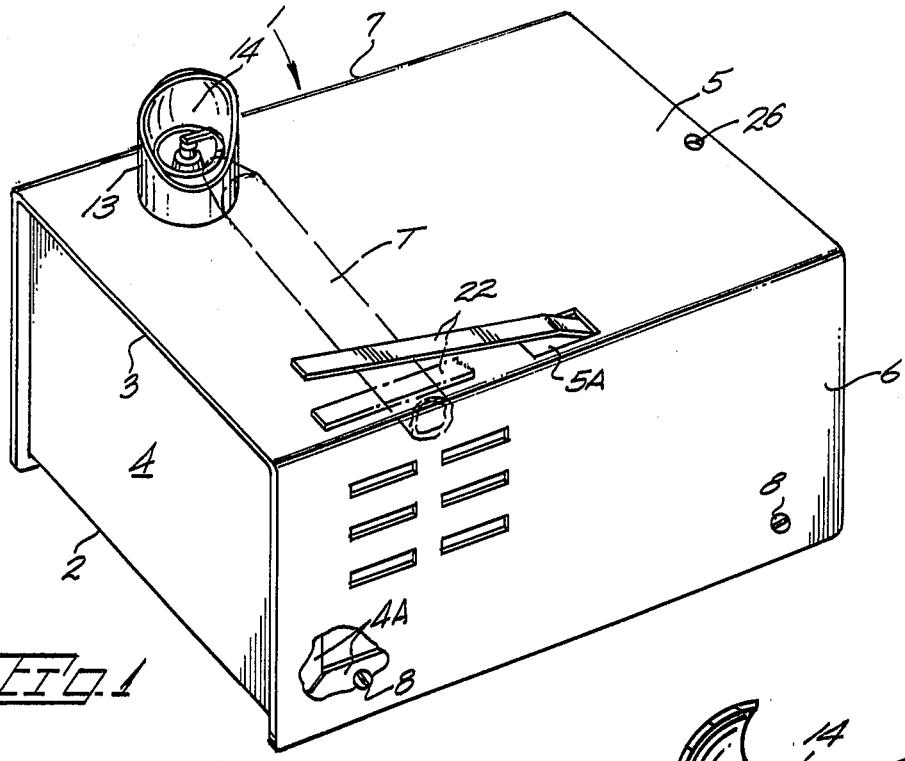
FIG. 1 is a perspective view of the present igniter.

With continuing attention to the drawing wherein applied reference numerals indicate parts similarly identified in the following description, the reference numeral 1 indicates generally the device with a housing comprised of a base portion 2 and a cover 3.

Base portion 2 has upstanding end walls 4 with inwardly turned flanges 4A over which cover 3 is mounted. The base includes feet not shown. Cover 3 is of inverted u-shape having a top wall 5 and side walls 6 and 7. Fasteners at 8 extend through the cover and flanges 4A of the base portion.

Figure 2:
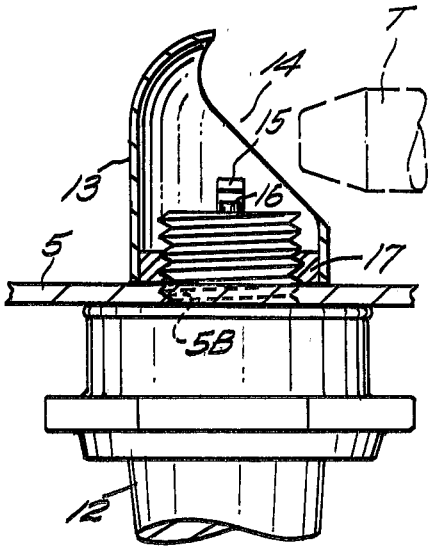
FIG. 2 is an enlarged sectional elevational view of the sparkplug, hood and housing combination.
Figure 3:
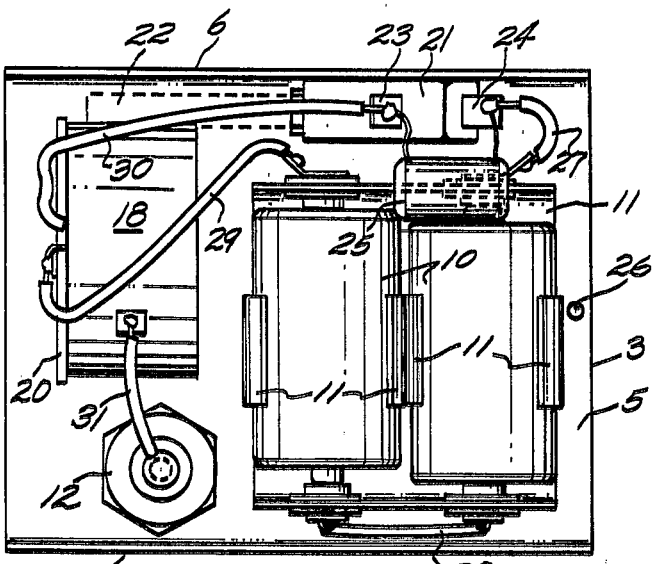
FIG. 3 is a plan view of an inverted housing cover with electrical components thereon.

The electrical components are secured to the underside of the cover and hence are fully accessible upon cover removal and inversion. Said components include dry cell batteries at 10 in series in place within a holder 11 secured to the cover underside. Indicated at 12 is a sparkplug constituting an arcing component which as shown in FIG. 2 is in supported engagement with cover top wall 5. The sparkplug tip is threaded through a wall opening at **5*b* and receives a partial enclosure or hood 13 open at one side at 14 to permit the entry of gas emitted from a torch tip T. Sparkplug electrodes are indicated at 15 and 16 and, upon arcing occurring thereacross, serve to ignite hood confined gasses. Said hood includes a ring at 17** which is shown in threaded engagement with the sparkplug tip.

Additional electrical components include a coil 18 mounted to the underside of top wall 5 by a bracket 20. A switch at 21 is also secured to cover 3 and includes a switch control arm 22 which projects outwardly through a top wall opening 5A. Said arm configured to be in proximity of the top wall surface so as to be contacted in a convenient manner by torch tip T during ignition thereof. Switch 21 is of the well known type requiring but limited movement of switch arm 22 to open and close internal switch contacts. In parallel with the switch terminals at 23 and 24 is a capacitor 25.

Housing 1 may be provided with an opening at 26 to facilitate attachment of the device on a tank supported hook when the device is used in conjunction with an oxy-acetylene torch.

The ignition circuit further includes insulated conductors at 27, 28, 29, 30 and a sparkplug lead at 31.

In use, the elongate arm 22 enables the user, whether right or left handed to simultaneously close an electrical ignition circuit for arcing across electrodes 15 and 16. Additionally hood 13 may be rotated slightly to best accomodate a right or left handed user. While a self-contained power source is shown it will be understood that the source may be external to the device.

While I have shown but one embodiment of the invention it will be apparent to those skilled in the art that the invention may be embodied still otherwise without departing from the spirit and scope of the invention claimed.

Having thus described the invention what is desired to be secured under a Letters Patent is:

1. A device for igniting gas fired torches, comprising in combination, a housing, electrical components located within said housing and including an arcing component projecting through a housing top wall to locate arcing electrodes exteriorly of said wall, said components including a switch having contacts closing a circuit to said arcing component, a hood open at one side and disposed about the exterior portion of said arcing component, said hood serving to confine gas emitted from a torch tip for ignition purposes, said hood in threaded engagement with the arcing component and serves to lock the same in place on said housing wall, and an elongate control arm for said switch projecting outwardly through an opening in said wall and adapted for downward displacement by a torch tip to close said switch while the torch tip end is in register with the hood opening for ignition of the torch.

* * * * *